US007505702B2

(12) United States Patent
Hong

(10) Patent No.: US 7,505,702 B2
(45) Date of Patent: Mar. 17, 2009

(54) HIGH POWER SUPPLY TO CONTROL AN ABNORMAL LOAD

(75) Inventor: Hyung-won Hong, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 199 days.

(21) Appl. No.: 11/371,103

(22) Filed: Mar. 9, 2006

(65) Prior Publication Data

US 2007/0071478 A1 Mar. 29, 2007

(30) Foreign Application Priority Data

Sep. 29, 2005 (KR) ..... 10-2005-0091285

(51) Int. Cl.
*G03G 15/00* (2006.01)

(52) U.S. Cl. ..... 399/37; 363/41; 399/88

(58) Field of Classification Search ..... 399/37, 399/88; 363/19, 21.18, 41, 56.11
See application file for complete search history.

(56) References Cited

U.S. PATENT DOCUMENTS

| | | | | |
|---|---|---|---|---|
| 2002/0006045 | A1 * | 1/2002 | Shirai et al. | 363/17 |
| 2006/0176717 | A1 * | 8/2006 | Chae et al. | 363/41 |

FOREIGN PATENT DOCUMENTS

| | | |
|---|---|---|
| CN | 1085022 | 4/1994 |
| CN | 1220515 | 6/1999 |
| JP | 06-308805 | 11/1994 |
| JP | 09-015944 | 1/1997 |
| JP | 09-218567 | 8/1997 |
| JP | 2000-333458 | 11/2000 |
| KR | 1989-007402 | 5/1989 |

OTHER PUBLICATIONS

Chinese Office Action dated May 23, 2008 issued in CN 2006-10131737.2.

* cited by examiner

*Primary Examiner*—Sophia S Chen
(74) *Attorney, Agent, or Firm*—Stanzione & Kim, LLP

(57) ABSTRACT

A high power supply to control an abnormal load includes a high voltage power processor to amplify a supplied DC power and to output the amplified DC power, a trans/rectifier to transform the DC power to a high voltage power and to rectify the high voltage power, a load detector to compare a load voltage output from a load with a predetermined reference voltage and to output a comparison voltage to detect the abnormal load of the load, and a high voltage controller to supply a chip enable signal to the high voltage power processor to interrupt the high voltage power processor when the comparison voltage output from the load detector is smaller than a predetermined reference value that is set to correspond to a minimum load of the load. Therefore, a user and peripheral components an image forming apparatus are protected from electric shock and being damaged by interrupting an output of the high voltage according to the abnormal load.

10 Claims, 3 Drawing Sheets

HIGH POWER SUPPLY TO CONTROL AN ABNORMAL LOAD

CROSS-REFERENCE TO RELATED APPLICATIONS

This application claims benefit under 35 U.S.C. § 119(a) of Korean Patent Application No. 2005-91285, filed on Sep. 29, 2005 in the Korean Intellectual Property Office, the entire contents of which are incorporated herein by reference.

BACKGROUND OF THE INVENTION

1. Field of the Invention

The present general inventive concept relates to a high power supply to control an abnormal load, more particularly, to a high power supply having an amplifying circuit formed in a single chip in an image forming apparatus, such as a laser printer or a laser multifunctional device, which detects an abnormal load at an output terminal using a load detecting sensor when the abnormal load is applied to the output terminal by a human resistance or a ground (GND) and interrupts an outputting operation of a high voltage by turning off the single chip amplifying circuit.

2. Description of the Related Art

Generally, a high power supply receives an input voltage of 5V or 24V from a switching mode power supply (SMPS) and a main board and generates a high voltage in response to a high/low signal of an engine controller or a pulse width modulation signal to form images during a transcription process. Also, the high power supply generates high voltage in a range of hundreds to thousands V using a transformer when receiving the 24V as the input voltage.

FIG. 1 is a circuit diagram illustrating a conventional high power supply.

Referring to FIG. 1, the conventional high power supply includes a controller 110, an input unit 120, an amplifier (OP-AMP) unit 130, a transformer 140, a rectifier 150, and an output unit 160.

The controller 110 supplies a PWM duty signal or an ON/OFF signal to the input unit 120 to output a high power signal. The input unit 120 converts the supplied power signal to a DC level signal suing a low pass filter having a resistor R1 and a capacitor C1 by turning on a transistor TR1 upon receiving the ON signal and outputs the DC level signal with a reference signal to the amplifier unit 130.

The amplifier unit 130 includes an OP amp and resistors R2 and R3 and generates an input signal to the transformer 140 in order to control a level of an output voltage. The transformer 140 turns on a driving transistor (TR2) according to a signal from the input unit 120. The transformer 140 controls a base current of the driving transistor TR2 to control a time constant and an output level of an oscillatory circuit at an input side of the transformer and to generate an AC type voltage at an output side of the transformer.

The rectifier 150 includes diodes D1 and D2 and capacitors C2, C3, and C4, receives the AC type voltage from an output side of the transformer 140 and generates a DC type voltage, and the DC type voltage is outputted through the output unit 160. Here, an electric power is consumed by a load 170 connected to an output terminal of the output unit 150, and a portion of a current flowing between the rectifier 150 and the output unit 160 is fed back to the amplifier unit 130 through a resistor R4 and the feedback unit 180 before the current is inputted to the output unit 160.

As described above, the high voltage is used to form images by transferring a toner in an image forming apparatus having a high voltage power supply, and a roller of a developing unit is recognized as the load. Therefore, if the load, i.e., developing unit, is not included in the image forming apparatus, high voltage is not required to be generated. The generation of the high voltage may cause a serious safety problem in an abnormal situation such as when the developing unit is taken out from the image forming apparatus.

That is, when a user opens a cover of the image forming apparatus to take out the developing unit from the image forming apparatus, the user may touch a high voltage terminal. Accordingly, the input voltage must be interrupted when the cover is opened. If the user takes out the developing unit from the image forming apparatus when a cover opening switch is malfunctioned or in an abnormal situation, the user may receive electric shock by the exposed high voltage terminal.

According to a safety standard for the high power supply, a human resistance is defined as 2 KΩ and is supplied at the output terminal when the high voltage is output, and a flowing current thereof is prevented to be exceeded 2 mA. However, if the output high voltage is shorted to the ground (GND) in an abnormal situation, it damages the electric circuit. Therefore, a safety device is required to prevent the high voltage when the output terminal is shorted to the ground or the human resistance.

SUMMARY OF THE INVENTION

An aspect of the present general inventive concept provides a high power supply having an amplifying circuit formed in a single chip in an image forming apparatus, such as a laser printer or a laser multifunctional device, which detects an abnormal load at an output terminal using a load detecting sensor when the abnormal load is applied to the output terminal by a human resistance or a ground (GND) and interrupts or controls an output of a high voltage by turning off the amplifying circuit formed in the single chip.

Additional aspects and advantages of the present general inventive concept will be set forth in part in the description which follows and, in part, will be obvious from the description, or may be learned by practice of the general inventive concept.

The foregoing and/or other aspects of the present inventive concept may be achieved by providing a high power supply to control an abnormal voltage, the high power supply including a high voltage power processor to amplify a supplied DC power and to output the amplified DC power, a trans/rectifier to transform the DC power to a high voltage power and to rectify the high voltage power, a load detector to compare a load voltage output from a load with a predetermined reference voltage and to output a comparison voltage representing a detection of an abnormal load, and a high voltage controller to supply a chip enable signal to the high voltage power processor to interrupt or control the high voltage power processor when the comparison voltage output from the load detector is smaller than a predetermined reference value that is set to correspond to a minimum value of the load.

The high voltage power processor may be a non-memory integrated circuit formed in a single monolithic chip.

The load detector may include a comparator to compare the load voltage and the predetermined reference voltage.

The high voltage controller may supply a low level as the chip enable signal to the high voltage power processor when a normal voltage output state is detected since the comparison voltage is greater than the predetermined reference value, and the high voltage controller may convert or change the low level of the chip enable signal to a high level as the chip enable signal and may supply the high level of the chip enable signal to the high voltage power processor when the load detector detects the load voltage smaller than the predetermined reference value.

The high voltage power processor may include a PWM interface to receive a pulse width modulation (PWM) signal from the high voltage controller, a program interface to communicate with an integrated chip (IC) in the high voltage controller, a program memory to store a program that determines an output of each output channel which is processed in the high voltage power processor, an oscillator to generate a frequency signal to operate the high voltage power processor, a power reset unit to reset a power source, an analog-to-digital converter to receive an analog signal and to convert the analog signal to a digital signal, and a digital regulator to compare a signal input from the PWM interface and a digital signal input from the analog-to-digital converter and to output the comparison result.

The program interface may perform a serial peripheral interface (SPI) communication with external units.

The foregoing and/or other aspects of the present inventive concept may also be achieved by providing a high power supply includes a high voltage power processor to amplify a supplied DC power and to output the amplified DC power, a trans/rectifier to transfer the DC power to a high voltage power and to rectify the transformed high voltage power, a load detector to compare a load voltage output from a load with a predetermined reference voltage and to output a comparison voltage representing a detection of an abnormal load, a high voltage controller to compare the comparison voltage with a predetermined reference value and to output one of a high level and a second level as a first control signal according to a comparison result thereof, and a load control selecting unit to receive a comparison voltage signal supplied from the load detector and the first control signal supplied from the high voltage controller and to supply a second control signal to the high voltage power processor to interrupt the high voltage power processor.

The second control signal may be a high level of the chip enable signal.

The high voltage power processor may be operated by receiving a low level of the chip enable signal from the high voltage controller when a normal operating state is detected.

The load control selecting unit may include a comparator to compare the comparison voltage supplied from the load detector and the predetermined reference value and to output the comparison result, an amplifier to amplify the comparison result, and a NAND circuit to receive the amplified comparison result and the first control signal and to output a high level of the second control signal if one of the received signals is a low level.

The foregoing and/or other aspects of the present inventive concept may also be achieved by providing an image forming apparatus comprising a main body, a load detachably installed in the main body, and a high power supply to supply a high voltage to the load installed in the main body, to detect a normal load and an abnormal load from the load supplied with the high voltage, and to control the high voltage to be supplied to the load according to the detected normal or abnormal load.

The foregoing and/or other aspects of the present inventive concept may also be achieved by providing an image forming apparatus comprising a main body, a load detachably installed in the main body, and a high power supply to supply a high voltage to the load installed in the main body, and having a feedback unit to detect the high voltage to be supplied to the load to output a feedback signal, and a load detector to detect a normal load and an abnormal load from the load supplied with the high voltage to output a load detecting signal, and control the high voltage supplied to the load according to the feedback signal and the load detecting signal.

BRIEF DESCRIPTION OF THE DRAWINGS

The above aspects and features of the present general inventive concept will be more apparent by describing certain embodiments of the present general inventive concept with reference to the accompanying drawings, in which.

DETAILED DESCRIPTION OF THE PREFERRED EMBODIMENTS

Figure 1:
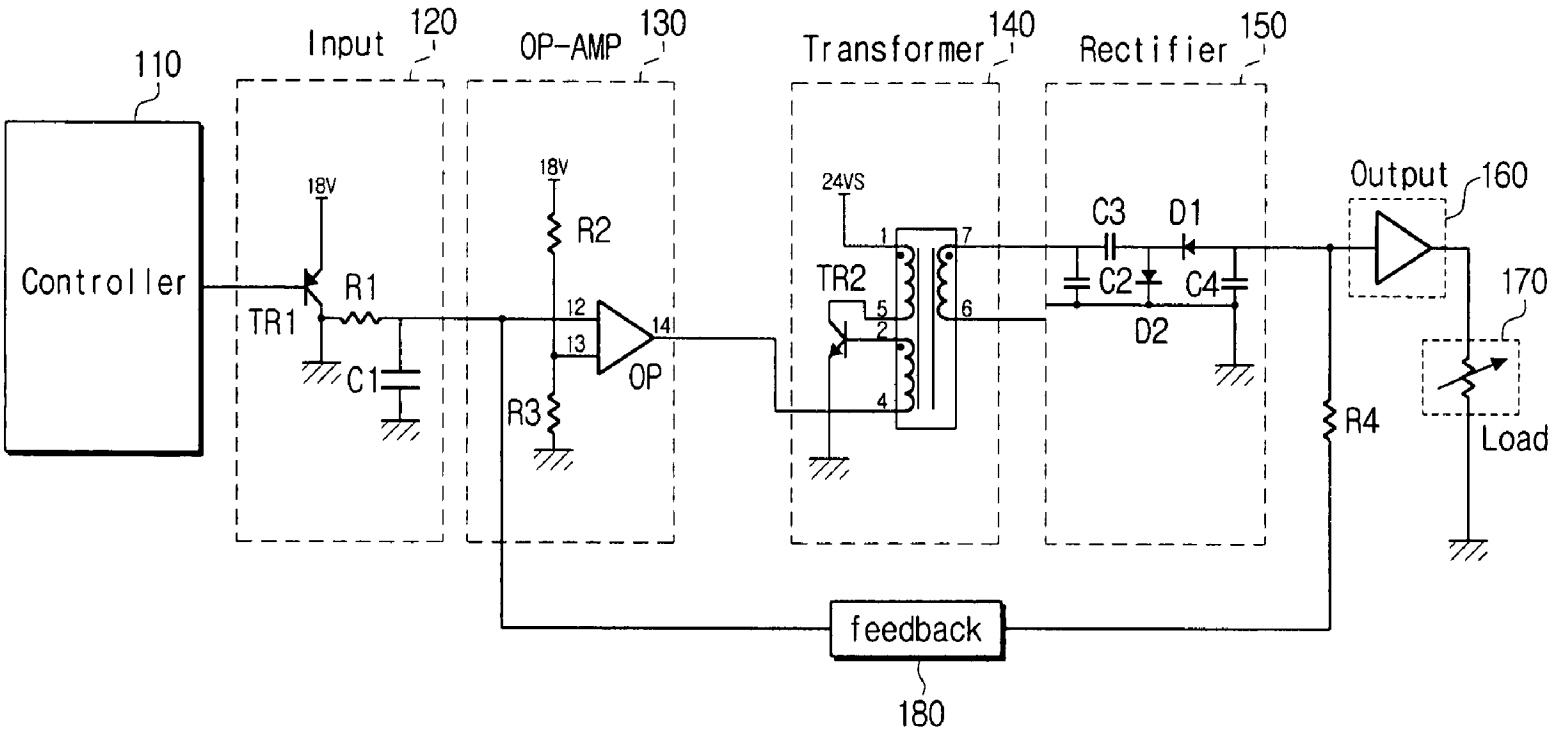
FIG. 1 (PRIOR ART)
FIG. 1 is a circuit diagram showing a conventional high power supply.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

If a load exists at an output terminal and a current flows though the load when a voltage, for example, a DC type high voltage, is output to the load, a load detecting electric potential is generated and detected by a load detector connected to the load, and the load detecting electric potential is supplied to an analog-to-digital converter (ADC) port of a high voltage controller in a high power supply according to an embodiment of the present general inventive concept. Here, a value of the load of a high voltage output terminal is greater than a minimum value of several MΩ. In this case, the high power supply according to the present embodiment sets a reference value corresponding to a voltage level of the minimum value of the load, compares the reference value with the load detecting electric potential, and interrupts an output of the high voltage if the load detecting electric potential is smaller than the reference value.

Figure 2:
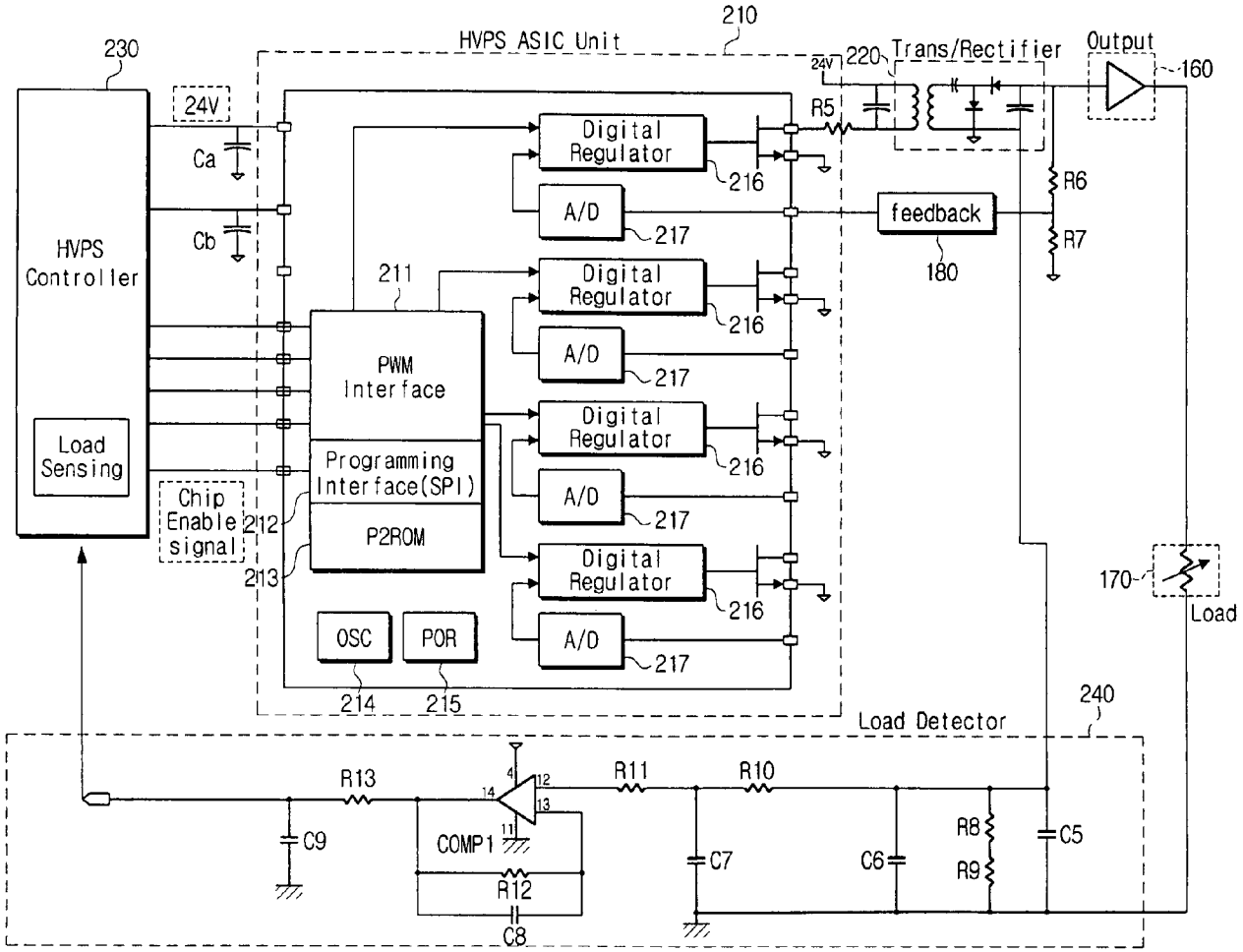
FIG. 2 is a circuit diagram illustrating a high power supply according to an embodiment of the present general inventive concept.

FIG. 2 is a schematic circuit diagram of a high power supply according to an embodiment of the present general inventive concept. The high power supply may be used in an image forming apparatus to supply a plurality of high voltages to various components of the image forming apparatus including a developing unit to supply a toner to develop a latent image of a photosensitive unit to form a toner image.

The high power supply according to the present embodiment includes a high voltage power supply application-specific integrated circuit (HVPS ASIC) 210, a trans/rectifier 220, a high voltage power supply (HVPS) controller 230, an output unit 160, a load 170, a feedback unit 180, and a load detector 240.

The HVPS ASIC 210 is not a general type of an integrated circuit (IC), i.e., a gate or an OP amp. The HVPS ASIC 210 may be a non-memory integrated circuit (IC) designed to control a high voltage power output according to the present embodiment. The HVPS ASIC 210 amplifies a DC power, for example, 24V, supplied from the HVPS controller 230 and outputs the amplified DC power to the output unit 160 through the trans/rectifier 220.

The trans/rectifier 230 transforms the amplified DC power of the 24V to a high voltage AC power and rectifies the high voltage AC power to output a high voltage DC power to the load 170 through the output unit 160.

The HVPS controller 230 detects a voltage level of the load 170 using the load detector 240. If the voltage level of the load 170 is lower than a predetermined reference value, the HVPS controller 230 converts or changes s chip enable signal from a low level to a high level and supplies the high level of the chip enable signal to the HVPS ASIC 210 so as to interrupt or control the HVPS ASIC 210. That is, the HVPS controller 230 controls the HVPS ASIC 210 not to output a voltage as the amplified DC power, thereby controlling the high voltage AC power and the high voltage DC power. The HVPS controller 230 is connected to the HVPS ASIC 210 through a plurality of signal lines. Capacitors Ca and Cb are connected to corresponding signal lines.

The load detector 240 compares the load voltage outputted from the load 170 and the predetermined reference voltage and supplies a comparison voltage to the HVPS controller 230 as a comparison result. The comparison voltage is supplied as digital type voltage data through an analog/digital converter (ADC) port of the HVPS controller 230, and the HVPS controller 230 determines whether the voltage data is smaller than a predetermined reference value or not.

The load detector 240 includes a first comparator (COMP1) to compare the load voltage with the predetermined reference voltage. That is, a first input terminal 12 of the first comparator (COMP1) is connected to the trans/rectifier 220 through two resistors R10 and R11, and one end of a capacitor C7 is connected a contact point between the two resistors R10 and R11 and the other end of the capacitor C7 is connected to the ground (GND) in parallel. Also, a contact point between the capacitor C7 and the ground is connected to the load 170. A capacitor C5, two resistors R8 and R9 connected in serial and a capacitor C6 are connected in parallel between a line connecting the two resistors R10 and R11 and the trans/rectifier 220 and a line connecting the capacitor C7 and the load 170. Furthermore, a resistor R12 and a capacitor C8 are connected in parallel between a second input terminal 13 of the first comparator (COMP1) and an output terminal 14. The output terminal 14 of the first comparator COMP1 is connected to the HVPS controller 230 through a resistor R13, and a capacitor C9 is connected in parallel between the ground and a line connecting the resistor R3 and the HVPS controller 230.

In the high voltage supply according to the present embodiment, the HVPS controller 230 supplies the low level of the chip enable signal to the HVPS ASIC 210 according to a first output signal of the first comparator (COMP1) when the load 170 is a normal load, so that the HVPS ASIC 210 outputs the high voltage power. However, if the load detector 240 detects the load voltage lower than the predetermined reference value, the HVPS controller 230 converts or changes the low level of the chip enable signal to the high level of the chip enable signal according to a second output signal of the first comparator (COMP1) and supplies the high level of the chip enable signal to the HVPS ASIC 210, so that the HVPS ASIC 210 is interrupted in response to the high level of the chip enable signal.

The HVPS ASIC 210 includes a PWM interface 211, a program interface 212, a program memory (P2ROM) 213, an oscillator (OSC) 214, a power reset unit (POR: power on reset) 215, a digital regulator 216 and an analog-to-digital converter (ADC) 217.

The PWM interface 211 receives a pulse width modulation (PWM) signal supplied from the HVPS controller 230 as an input signal, processes the input signal, and outputs the processed signal as a target output using a regulator to corresponding components. When a plurality of PWM signals are supplied to the HVPS ASIC 210 through the PWN interface 211, a plurality of target outputs are generate to control corresponding ones of the digital regulators 216, so that corresponding components of the image forming apparatus are controlled.

The program interface 212 is a serial peripheral interface (SPI) to communicate with a peripheral integrated circuit (IC). That is, the program interface 212 performs communication with other IC in the HVPS controller 230.

The program memory (P2ROM) 213 stores programs to determine an output of each output channel. For example, if the HVPS controller 230 is controlled to output the PWM signal A and the HVPS ASIC 210 is controlled to output an output voltage of '1000,' and a setting value is generated through a program and the setting value is uploaded to the program memory 213.

The oscillator 214 oscillates to generate a frequency signal to operate the HVPS ASIC 210 which is a single monolithic IC having peripheral ICs, and the power reset unit (POR) 215 resets the power source.

The digital regulator 216 compares a signal input from the PWM interface 211 and a digital signal input from the corresponding ADC 217 and controls an output to the corresponding component based on a comparison result thereof.

The ADC 217 receives an analog signal and converts the received analog signal to a digital signal.

The high power supply according to the present embodiment includes a plurality of the digital regulators 216 and the ADCs 217 which are connected to the PWM interface 211. The trans/rectifier 220 is connected to the HVPS controller 210 (for example, one of the digital regulators 216 through a transistor and a resistor R5. The feedback unit 180 is connected to the output terminal of the trans/rectifier 220 through resistors R6 and R7, and the feedback unit 180 is also connected to the HVPS ASIC 210 through resistors R6 and R7.

Figure 3:
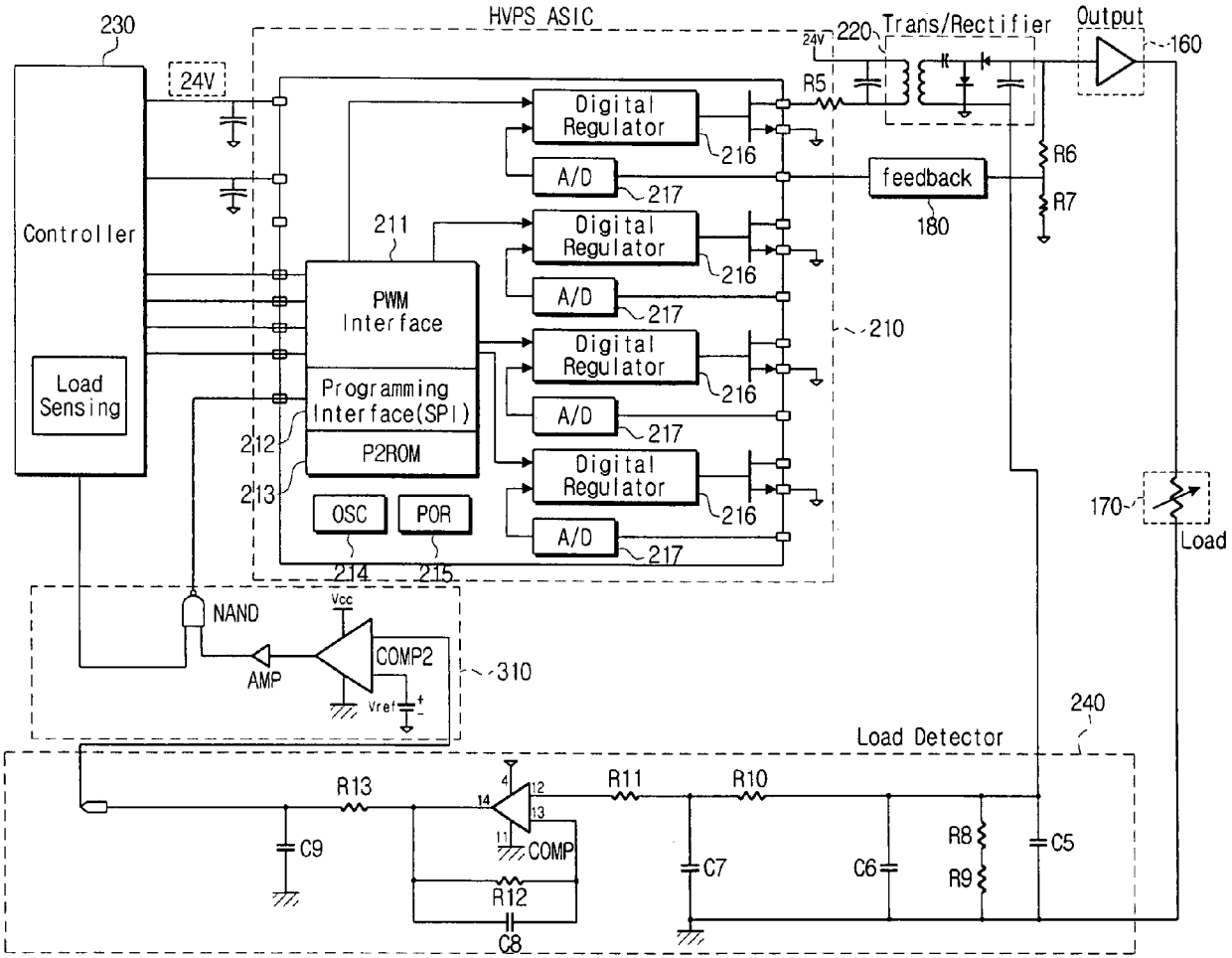
FIG. 3 is a circuit diagram illustrating a high power supply according to an embodiment of the present general inventive concept.

FIG. 3 is a circuit diagram illustrating a high power supply according to an embodiment of the present general inventive concept.

The high power supply of FIG, 3 automatically interrupts the HVPS ASIC 210 without receiving a control signal of the HVPS controller 230 when the load detector 240 detects an abnormal load, and the HVPS controller 230 is malfunctioned or generates an error signal.

In order to automatically control the HVPS ASIC 210 without receiving the control of the HVPS controller 230, the high power supply includes a load control selecting unit 310 as shown in FIG. 3.

The load control selecting unit 310 includes a second comparator (COMP2), an AMP and a NAND circuit (gate). The second comparator (COMP2) receives an abnormal load voltage output from the load detector 240 and compares the received load voltage with a predetermined reference value (Vref). If the received load voltage is normal, the second comparator (COMP2) outputs a high signal to the NAND circuit. On the contrary, if the received load voltage is abnormal, the second comparator (COMP2) outputs a low signal to the NAND circuit. The NAND circuit also receives a chip enable signal from the HVPS controller 230. If one of the two received signals is a low level, the NAND circuit supplies the high level as the chip enable signal to the HVPS ASIC 210.

Therefore, the HVPS ASIC 210 is interrupted to output the high power in response to the high level of the chip enable signal.

If the HVPS controller 230 detects the abnormal load using the load detector 240, the HVPS controller 230 interrupt a power of 24V that is supplied to the HVPS ASIC 210 as shown in FIG. 3 instead of supplying the chip enable signal to the HVPS ASIC 210. Accordingly, the HVPS ASIC 210 is interrupted and the output unit 160 is controlled not to output the high voltage to the load 170.

As described above, the high power supply controls the HVPS ASIC not to output the high voltage by detecting the voltage level of the load at the high power output terminal since the load at the high voltage output terminal is lower than the reference value when a user takes out the developing unit from the image forming apparatus in the abnormal situation or when the cover opening switch is malfunctioned. Therefore, the user can be protected from being electrically shocked due to the high voltage that can occur when a user takes out the load, for example, a developing unit, from the image forming apparatus. Furthermore, peripheral components can be protected although the high voltage output terminal is shorted by the ground since the high power supply according to the present embodiment interrupts an output of the high voltage by detecting the abnormal load.

As described above, the high power supply can be used in an apparatus having a unit supplied with a high voltage generated from the high power supply. When the unit is taken out from the apparatus, the high power supply controls the high voltage to avoid any injury to a user due to the high voltage. The apparatus may be an image forming apparatus in which a developing roller supplies a toner to a latent image of a photosensitive unit using the high voltage. The developing unit is recognized as the load in the high voltage power supply. When the developing unit is taken out from the image forming apparatus, the load detector 240 recognizes that the load 170 is abnormal. That is, if the load, i.e., developing unit, is not included in the image forming apparatus, the high voltage is not required. The generation of the high voltage may cause a serious safety problem in an abnormal situation such as when the developing unit is taken out from the image forming apparatus.

That is, when a user opens a cover of the image forming apparatus to take out the developing unit therefrom, a sensor may fail to detect an opening state of the cover so as not to supply the high voltage to a high voltage terminal corresponding to the developing unit, and the user may touch the high voltage terminal receiving the high voltage. Accordingly, the input voltage needs to be interrupted when the cover is opened, so that the output voltage of the high voltage terminal is prevented from being generated. Even if the user takes out the developing unit from the image forming apparatus when a cover opening switch is malfunctioned or in an abnormal situation, the high voltage power supply according to the present embodiment can prevent an electric shock by the exposed high voltage terminal.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A high power supply to control an abnormal voltage, comprising:

a high voltage power processor to amplify a supplied DC power and to output the amplified DC power;

a trans/rectifier to transform the DC power to a high voltage power and to rectify the high voltage power;

a load detector to compare a load voltage output from a load with a predetermined reference voltage and to output a comparison voltage to detect an abnormal load corresponding to the load; and a high voltage controller to supply a chip enable signal to the high voltage power processor to interrupt the high voltage power processor when the comparison voltage output from the load detector is smaller than a predetermined reference value that is set to correspond to a minimum load of the load.

2. The high power supply of claim 1, wherein the high voltage power processor is a non-memory integrated chip (IC).

3. The high power supply of claim 1, wherein the load detector comprises a comparator to compare the load voltage and the predetermined reference voltage.

4. The high power supply of claim 1, wherein the high voltage controller supplies a low level of the chip enable signal to the high voltage power processor according to a normal voltage output state of the load detected when the comparison voltage is greater than the predetermined reference value, and the high voltage controller converts the low level of the chip enable signal to a high level of the chip enable signal and supplies the high level of the chip enable signal to the high voltage power processor according to an abnormal voltage output state of the load detected when the comparison voltage is smaller than the predetermined reference value.

5. The high power supply of claim 1, wherein the high voltage power processor comprises:

a PWM interface to receive a pulse width modulation (PWM) signal from the high voltage controller;

a program interface to communicate with an integrated chip (IC) in the high voltage controller;

a program memory to store a program that determines an output of each output channel;

an oscillator generate a frequency signal to operate the high voltage power processor;

a power reset unit to reset a power source;

an analog-to-digital converter to receive an analog signal and to convert the analog signal to a digital signal; and a digital regulator to compare a signal input from the PWM interface and a digital signal input from the analog-to-digital converter and to output a comparison result of the signal and the digital signal.

6. The high power supply of claim 5, wherein the program interface performs a serial peripheral interface (SPI) communication.

7. A high power supply comprising:

a high voltage power processor to amplify a supplied DC power and to output the amplified DC power;

a trans/rectifier to transform the DC power to a high voltage power and to rectify the transformed high voltage power;

a load detector compare a load voltage output from a load with a predetermined reference voltage and to output a comparison voltage as a comparing result to detect an abnormal load of the load;

a high voltage controller to compare the comparison voltage with a predetermined reference value and output a first control signal having one of a high level and a low level according to the comparison voltage; and a load control selecting unit to receive the comparison voltage supplied from the load detector and the first control signal supplied from the high voltage controller and to supply a second control signal to the high voltage power processor to interrupt the high voltage power processor.

8. The high power supply of claim 7, wherein the second control signal is a high level of a chip enable signal.

9. The high power supply of claim 7, wherein the high voltage power processor is operated upon receiving a low level of a chip enable signal as the second control signal from the high voltage controller when a normal operating state of the load is detected.

10. The high power supply of claim 7, wherein the load control selecting unit includes:

a comparator to compare the comparison voltage supplied from the load detector and the predetermined reference value and to output a second comparison result;

an amplifier to amplify the second comparison result; and a NAND circuit to receive the amplified comparison result and the first control signal and to output a high level of the second control signal if one of the received signals is a low level.

* * * * *